United States Patent [19]

Niederkorn

[11] Patent Number: 5,050,514

[45] Date of Patent: Sep. 24, 1991

[54] SATIN STITCH PRESSER FOOT HAVING THREAD AND FABRIC GUIDES

[76] Inventor: Clare J. Niederkorn, 1371 Calle Violeta, Thousand Oaks, Calif. 91360

[21] Appl. No.: 495,999

[22] Filed: Mar. 20, 1990

[51] Int. Cl.[5] ..... D05B 29/00; D05B 29/08; D05B 29/12

[52] U.S. Cl. ..... 112/235; 112/153; 112/136; 112/141

[58] Field of Search ..... 112/60, 80.31, 80.32, 112/121.23, 136, 141, 153, 306, 308, 314, 320, 324, 235–240, 265.1

[56] References Cited

U.S. PATENT DOCUMENTS

| | | | |
|---|---|---|---|
| 1,765,604 | 6/1930 | Moffatt | 112/235 |
| 2,241,778 | 5/1941 | Giancola | 112/235 |
| 2,706,460 | 4/1955 | Grossman | 112/235 |
| 3,005,429 | 10/1961 | Weschler | 112/153 X |
| 3,137,255 | 6/1964 | Carp | 112/235 X |
| 3,786,770 | 1/1974 | Nishi | 112/235 |
| 4,226,197 | 10/1980 | Pollmeier et al. | 112/308 X |
| 4,244,312 | 1/1981 | Bialy | 112/235 |
| 4,473,019 | 9/1984 | Hanyu et al. | 112/235 |

FOREIGN PATENT DOCUMENTS

| | | | |
|---|---|---|---|
| 2852299 | 1/1980 | Fed. Rep. of Germany | 112/235 |
| 2002997 | 1/1987 | Japan | 112/235 |
| 0985175 | 12/1982 | U.S.S.R. | 112/235 |

*Primary Examiner*—Werner H. Schroeder
*Assistant Examiner*—Ismael Izaguirre
*Attorney, Agent, or Firm*—Kelly, Bauersfeld & Lowry

[57] ABSTRACT

A self-guiding zig-zag satin stitch presser edge foot includes a sole to be pressed against a fabric to be sewn and a fabric guide for engaging an edge of the fabric. The fabric guide carriers a thread guide pin which lies adjacent to the edge of the fabric. The fabric guide and the thread guide pin are laterally movable, as a unit, by the positioning of a nut on a threaded shank which is fixed relative to the sole. Extending upwardly from the fabric guide is a U-shaped yoke which is slidably received onto the threaded shank. A nut, which is threaded onto the shank, is positioned within the yoke to move the fabric guide and the thread guide pin as the nut is rotated about the shank. The sole includes a channel formed on the underside thereof rearwardly of a needle dropping hole, having a sufficient depth to permit a thickened satin-stitch hem to pass therethrough.

17 Claims, 2 Drawing Sheets

FIG. 1
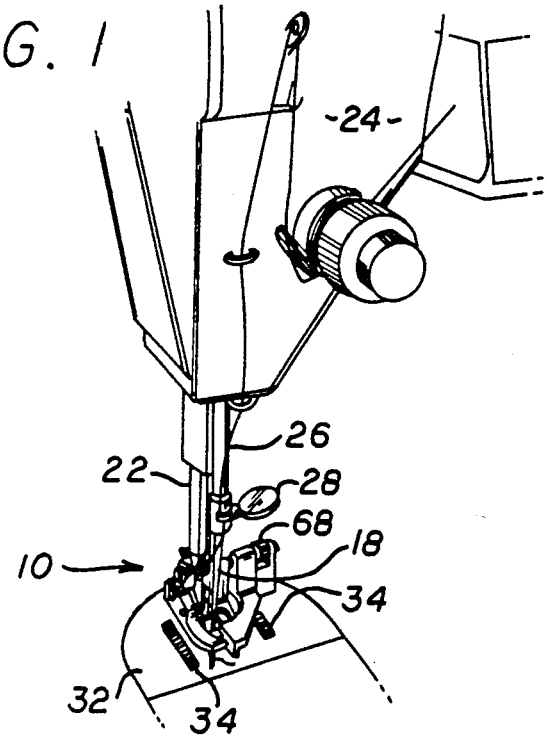
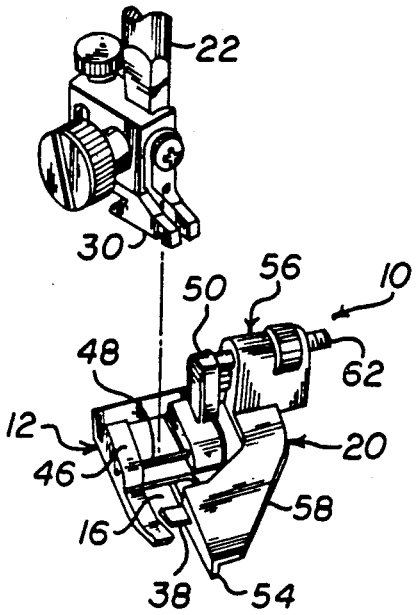
FIG. 2
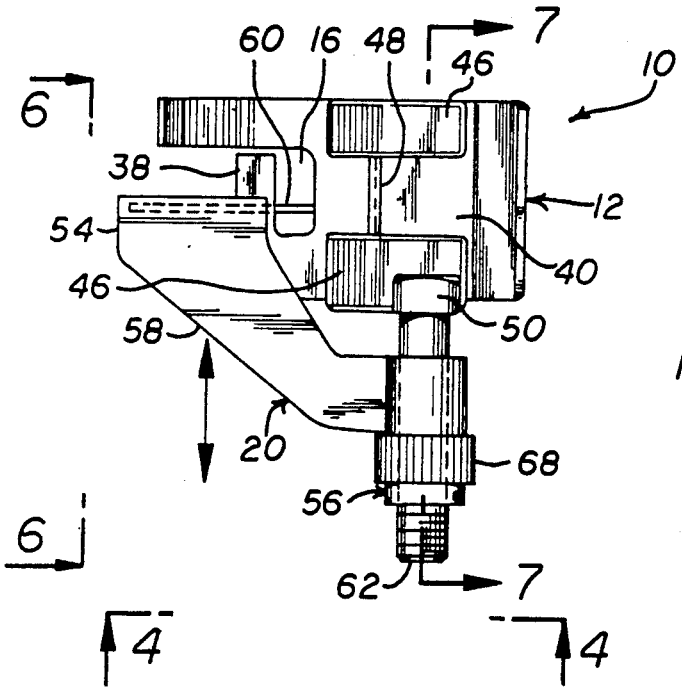
FIG. 3
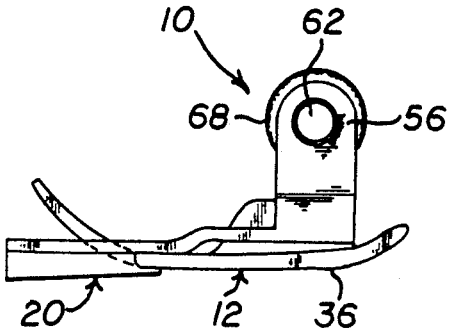
FIG. 4

FIG. 5
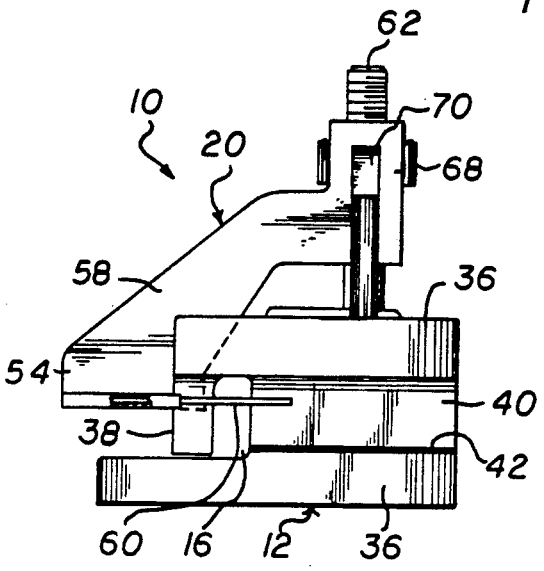
FIG. 6
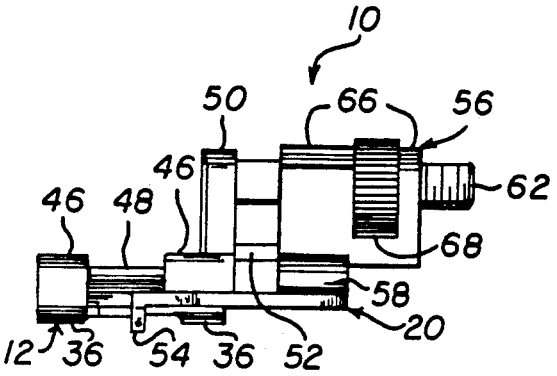
FIG. 7
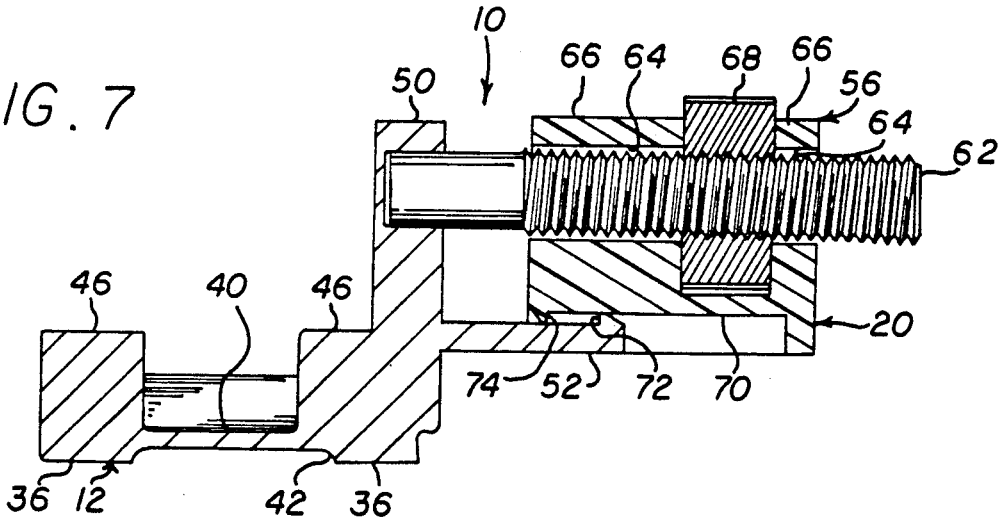
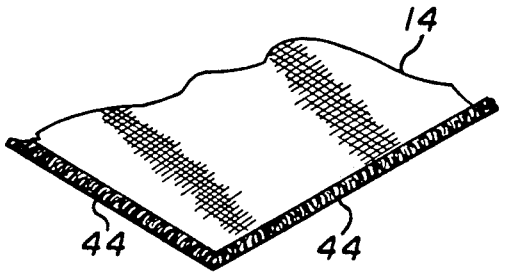
FIG. 8

SATIN STITCH PRESSER FOOT HAVING THREAD AND FABRIC GUIDES

BACKGROUND OF THE INVENTION

This invention relates generally to sewing machines. More particularly, the present invention relates to a hem stitching presser foot used in combination with a sewing machine.

Hem stitches are generally formed with threads which comprise a first portion located in the fabric when a needle penetrates the fabric, and a second portion located on the outside of the fabric edge. Often a standard zig-zag sewing machine action is utilized to hem the edge of a piece of fabric in order to prevent fabric fraying and to create a uniform sewn edge.

In a hem stitching operation it is usually desirable to provide stitches of uniform width and separation. It is known, however, that hem stitching operations carried out in a conventional manner often result in skipped stitches and thread severance. As pointed out in U.S. Pat. No. 4,473,019 (the contents of which are incorporated herein), skipped stitches have resulted from the fact that a loop taker hook often fails to catch a thread loop, and thread severance has resulted from the fact that the upper thread tends to be disordered as it is pulled up by a thread take-up lever due to the absence of the base fabric against the point of the needle. The above-mentioned patent provides a hem stitching presser foot for sewing machines which provides friction to the thread as it passes outside of the fabric edge, to thereby ensure a more uniform stitch pattern.

In addition to normal zig-zag hem stitches, it is desirable in some instances to provide a different type of hem stitch for aesthetic and/or functional reasons. More particularly, sometimes is it desirable to provide a satin stitch hem along the edge of a piece of fabric. A satin stitch is distinguishable from the normal zig-zag stitch in that the successive loops of thread lie substantially adjacent to or on top of one another to form a continuous border of hem threads.

Accordingly, there has been a need for a novel adjustable satin stitch presser foot which can be used in connection with virtually all types of zig-zag sewing machines, and which is capable of efficiently producing a desired satin stitch hem. Such a novel presser foot should provide stitches of uniform width and length, and be capable of use with a wide variety of thread types. Additionally, a satin stitch presser foot is needed which requires little skill to use, and permits use of the presser foot with a wide variety of fabric types. Moreover, a novel satin stitch presser foot is needed which has the ability to quickly hem around a sharp corner of a piece of fabric, such as the corner of a napkin or tablecloth. The present invention fulfills these needs and provides other related advantages.

SUMMARY OF THE INVENTION

The present invention resides in an improved presser foot for a hem stitching operation, utilized in connection with a sewing machine having a needle vertically reciprocating and also laterally swingable. The presser foot is detachably mounted to a lower end of a presser bar of the sewing machine, and includes a sole to be pressed against a fabric to be sewn and a needle dropping hole formed in the sole for allowing the needle to penetrate the fabric. A fabric guide is provided for engaging an edge of the fabric and to guide the fabric therealong. Means are provided for adjustably positioning the fabric guide laterally with respect to the needle dropping hole.

In a preferred form of the invention, the sole includes two parallel fabric-engaging skis which extend the length of the sole in the fabric feeding direction. These skis define the lateral limits of the needle dropping hole. A front lateral bar extends from one of the skis to define a forward limit of the needle dropping hole, and a heel portion extends between the skis to define a rearward limit of the needle dropping hole. The heel portion and the skis cooperatively define a channel on the underside of the sole. This channel is of sufficient depth to permit a thickened satin-stitch hem to pass therethrough.

The fabric guide is generally L-shaped and comprises an upwardly extending U-shaped yoke. The fabric guide positioning means includes a threaded shank fixed with respect to the sole, which shank extends through aligned apertures in the yoke. A nut is positioned within the yoke and is threaded onto the shank such that movement of the nut along the threaded shank causes a corresponding lateral movement of the fabric guide relative to the sole.

The fabric guide positioning means further includes means for preventing pivotal movement of the fabric guide relative to the threaded shank. This preventing means includes a stop guide pin fixed relative to the sole. The stop guide pin is spaced from and extends parallel to the threaded shank, and engages a portion of the L-shaped fabric guide below the yoke. The stop guide pin further includes means for preventing disassociation of the fabric guide from the sole.

A thread guide pin is fixed within a portion of the fabric guide and lies adjacent to the edge of the fabric to be hemmed. The thread guide pin extends below the needle dropping hole and lies parallel to the fabric feeding direction.

The satin stitch presser foot of the present invention requires little skill to use and permits the use of a wide variety of thread types on most types of zig-zag sewing machines. A uniform stitch width and length can easily be accomplished through the presser foot of the present invention.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an environmental perspective view of a satin stitch presser foot embodying the invention as utilized in connection with a sewing machine having a needle which is vertically reciprocating and also laterally swingable;

FIG. 2 is an enlarged perspective view of the satin stitch presser foot illustrated in FIG. 1, showing the manner in which the presser foot can be snap-fit onto the presser bar of the sewing machine;

FIG. 3 is an enlarged top plan view of the satin stitch presser foot illustrated in FIGS. 1 and 2;

FIG. 4 is an elevational view of the presser foot taken generally in the direction of arrows 4-4 of FIG. 3;

FIG. 5 is a bottom plan view of the satin stitch presser foot embodying the invention;

FIG. 6 is a front elevational view of the presser foot taken generally in the direction of arrows 6—6 of FIG. 3;

FIG. 7 is an enlarged, partially sectional view taken generally along the line 7—7 of FIG. 3; and FIG. 8 is a fragmented perspective view of a piece of fabric having a satin edge sewn thereon utilizing the presser foot of the present invention.

DETAILED DESCRIPTION OF THE PREFERRED EMBODIMENT

As shown in the drawings for purposes of illustration, the present invention is concerned with an improved satin stitch presser foot, generally designated in the accompanying drawings by the reference number 10. The improved presser foot 10 comprises, generally, a sole 12 which is pressed against a fabric 14 to be sewn, a needle dropping hole 16 formed in the sole for allowing a needle 18 to penetrate the fabric, and a thread and fabric guide assembly 20 which engages an edge of the fabric.

As illustrated in a working environment in FIGS. 1 and 2, the satin stitch presser foot 10 is detachably mounted to a lower end of a presser bar 22 of a sewing machine 24. The needle 18 is attached to a needle bar 26 by means of a needle screw 28. In a zig-zag sewing machine 24, the needle is vertically reciprocated and swingable laterally of a fabric feeding direction. The presser foot 10 is snap-fit onto a presser foot shank 30 situated at the lowermost end of the presser bar 22. When rigged for sewing, the presser foot 10 overlies a throat plate 32 and one or more feed dogs 34 which help move the fabric 14 in the fabric feeding direction during the sewing operation.

In accordance with the present invention, and as illustrated with respect to a preferred embodiment in FIGS. 2 through 7, the satin stitch presser foot 10 comprises the aforementioned sole 12 which is provided inside with the laterally elongated needle dropping hole 16. The sole 12 includes two parallel fabric-engaging skis 36 which extend the length thereof in the fabric feeding direction and which define the lateral limits of the needle dropping hole 16. A front lateral bar 38 extends from one of the skis 36 to define a forward limit of the needle dropping hole. A shallow channel defined by the front lateral bar 38 and the skis 36 is formed on the underside of the sole. The sole 12 further includes a heel portion 40 which extends between the skis to define a rearward limit of the needle dropping hole 16. The heel portion and the skis cooperatively define a channel 42 on the underside of the sole, having sufficient depth to permit a thickened satin stitch hem 44 (FIG. 8) to pass therethrough.

The sole 12 further includes a pair of laterally spaced abutments 46 which are formed adjacent to the needle dropping hole 16 on the side thereof. A pin 48 laterally extends between the abutments 46, by which the presser foot 10 may be detachably mounted to the presser foot shank 30. Extending upwardly from the outermost one of the abutments 46, is a support 50 for the thread and fabric guide assembly 20. Extending laterally outwardly from the support 50 is a stop guide arm 52 which cooperates with a portion of the guide assembly 20 to prevent unwanted rotation thereof.

The thread and fabric guide assembly 20 is adjustably attached to the sole 12 and is provided means for moving the assembly 20 laterally with respect to the sole. The guide assembly 20 includes a fabric guide 54 which is adjustably positionable to engage an edge of the fabric 14, an upwardly extending U-shaped yoke 56, and an intermediate portion 58 formed integrally with the fabric guide 54 and the yoke 56. A thread guide pin 60 is fixed within a portion of the fabric guide 54 to lie adjacent to the outer edge of the fabric 14. The thread guide pin 60 extends parallel to the fabric feeding direction and below both the front lateral bar 38 and the needle dropping hole 16.

Means are provided for adjustably positioning the guide assembly 20 with respect to the sole 12. In particular, a threaded shank 62 is fixed within the upper end of the support 50, and extends laterally outwardly therefrom. The shank 62 is slidably positioned within apertures 64 provided through the upwardly extending members 66 of the U-shaped yoke 56. A nut 68 is threaded onto the shank 62 and positioned between these upwardly extending members 66. This arrangement causes the yoke 56, and consequently the entire guide assembly 20, to move laterally along the shank 62 as the nut 68 is turned thereon.

Situated directly below the aligned apertures 64 and the shank 62, the guide assembly 20 also includes a receiving groove 70 for the stop guide arm 52. The interaction of the stop guide arm 52 within the receiving groove 70 acts as means for preventing pivotal movement of the guide assembly 20 relative to the threaded shank 62. As illustrated in FIG. 7, the stop guide pin 52 includes a latch tooth 72 at one end. This latch tooth is configured to catch on a flange 74 provided at the inner lateral end of the receiving groove 70, to prevent disassociation of the guide assembly 20 from the sole 12.

As mentioned previously, a small or shallow channel may be formed beneath the front lateral bar 38. This shallow channel primarily accommodates positioning of the thread guide pin 60. The channel 42 formed by the heel portion 40 and the skis 36 has a greater depth in order to accommodate the thickened satin stitch hem 44 as it passes under the sole 12.

To use the satin stitch presser foot 10 of the present invention, the pin 48 is snap-fit into receiving grooves provided on the presser foot shank 30 (FIG. 2). An appropriate needle should be selected to obtain the desired stitching effects. When utilizing 100% cotton thread, a 70/10 sharp (705B) style is recommended. When utilizing cotton covered polyester thread, an 80/12 sharp (705B) style needle is recommended. When stretch fabrics are being sewn, a 75/11 HS stretch style needle is recommended. For machines that cannot use this needle, a 75/11 SUK style needle is recommended.

The illustrated presser foot 10 may be utilized with zig-zag stitches ranging in width from 1.5mm to 5.0mm. After the sewing machine 24 is set up in the standard manner, the fabric guide 54 is positioned immediately adjacent to the right edge of the fabric 14. The sewing machine 24 must be adjusted so that the needle 18 will strike the fabric with its very first stitch. The machine must also be set to sew on the left side of its zig-zag swing. The cooperation of the nut 68 with the threaded shank 62 permits the fabric guide 54 to be located in the most desirable position. The lateral or zig-zag swing of the needle 18 must be such that it passes over the thread guide pin 60 in order to ensure that the desired satin stitch hem 44 is sewn.

When making napkins, it is usually necessary to turn corners. Utilizing the presser foot 10 it is not necessary to sew off the edge and begin again. More particularly, in turning corners, the seamstress sews until the edge of the fabric is reached, and then the sewing operation is stopped with the needle in the up position. An inch of slack should be pulled on the needle thread between the last thread guide and the needle eye. The presser foot is then lifted, and the fabric is pulled back gently, just to remove the stitch from the pin that the machine sews over. The presser foot 10 is then placed back down onto the fabric 14 so that the needle will strike the stitches already sewn. Sometimes is is necessary to assist the machine in turning the corner by placing some fabric just under the backside of the foot 10 and up against the edge of the fabric.

From the foregoing it is to be appreciated that the improved satin stitch presser foot 10 is capable of sewing a satin stitch hem having uniform stitch width and length. The ability to turn corners is provided, and little skill is required to utilize the presser foot. The adjustability of the guide assembly 20 relative to the sole 12 permits the presser foot 10 to be used in connection with many different types of fabrics and on many machines.

Although a particular embodiment of the invention has been described in detail for purposes of illustration, various modifications may be made without departing from the spirit and scope of the invention. Accordingly, the invention is not to be limited, except as by the appended claims.

I claim:

1. A hem stitching presser foot detachably mounted to a lower end of a presser bar of a sewing machine having a needle vertically reciprocated and swingable laterally of a fabric feeding direction, the presser foot comprising:

a sole to be pressed against a fabric to be sewn;

a needle dropping hole formed in the sole for allowing the needle to penetrate the fabric;

a fabric guide associated with the sole for engaging an edge of the fabric to guide the fabric therealong; and a thread guide pin fixed relative to the fabric guide and extending below the needle dropping hole, wherein the thread guide pin lies parallel to the fabric feeding direction;

wherein the sole includes parallel fabric-engaging skis extending the length of the sole in the fabric feeding direction and defining the lateral limits of the needle dropping hole, a front lateral bar extending across the thread guide pin to define a forward limit of the needle dropping hole, and a heel portion extending between the skis to define a rearward limit of the needle dropping hole, wherein the heel portion and the skis cooperatively define a channel on the underside of the sole of sufficient depth to accommodate a thickened satin-stitch hem passing therethrough.

2. A presser foot as set forth in claim 1, including means for adjustably positioning the fabric guide laterally with respect to the needle dropping hole.

3. A presser foot as set forth in claim 2, wherein the fabric guide positioning means includes a threaded shank fixed with respect to the sole, a nut threaded onto the shank, and means cooperating with the nut for moving the fabric guide in accordance with movement of the nut on the threaded shank.

4. A presser foot as set forth in claim 3, wherein the means cooperating with the nut for moving the fabric guide includes a U-shaped yoke formed with the fabric guide, for receiving the nut therein, wherein the yoke includes aligned apertures, and wherein the shank slidably passes through the aligned apertures.

5. A presser foot as set forth in claim 3, wherein the fabric guide positioning means further includes means for preventing pivotal movement, relative to the threaded shank, of the means cooperating with the nut for moving the fabric guide.

6. A presser foot as set forth in claim 5, wherein the preventing means includes a stop guide pin spaced from and extending parallel to the threaded shank, for engaging the means cooperating with the nut for moving the fabric guide.

7. A presser foot as set forth in claim 6, wherein the stop guide pin includes means for preventing disassociation of the fabric guide from the sole.

8. A presser foot as set forth in claim 1, wherein the thread guide pin is fixed within a portion of the fabric guide to lie adjacent to the edge of the fabric.

9. A hem stitching presser foot detachably mounted to a lower end of a presser bar of a sewing machine having a needle vertically reciprocated and swingable laterally of a fabric feeding direction, the presser foot comprising:

a sole to be pressed against a fabric to be sewn;

a needle dropping hole formed in the sole for allowing the needle to penetrate the fabric;

a fabric guide for engaging an edge of the fabric to guide the fabric therealong; and means for adjustably positioning the fabric guide laterally with respect to the needle dropping hole;

wherein the sole includes parallel fabric-engaging skis extending the length of the sole in the fabric feeding direction and defining the lateral limits of the needle dropping hole, a front lateral bar extending from at least one of the skis to define a forward limit of the needle dropping hole, and a heel portion extending between the skis to define a rearward limit of the needle dropping hole.

10. A presser foot as set forth in claim 9, wherein the heel portion and the skis cooperatively define a channel on the underside of the sole, of sufficient depth to accommodate a thickened satin-stitch hem passing therethrough.

11. A presser foot as set forth in claim 10, wherein the channel formed by the heel portion and the skis has a greater depth than a channel cooperatively defined, on the underside of the sole, by the skis and the front lateral bar.

12. A presser bar as set forth in claim 9, including a thread guide pin fixed within a portion of the fabric guide to lie adjacent to and parallel with the edge of the fabric, wherein the thread guide pin extends below the needle dropping hole and lies parallel to the fabric feeding direction.

13. A presser foot as set forth in claim 9, wherein the fabric guide includes a U-shaped yoke, and wherein the fabric guide positioning means includes a threaded shank fixed with respect to the sole and slidably extending through aligned apertures provided through the U-shaped yoke, and a nut threaded onto the shank and positioned within the U-shaped yoke such that rotation of the nut about the shank displaces the fabric guide laterally with respect to the sole.

14. A presser foot as set forth in claim 13, wherein the fabric guide positioning means further includes means for preventing pivotal movement of the fabric guide relative to the threaded shank, the preventing means including a stop guide pin fixed relative to the sole and extending parallel to the threaded shank, such that the stop guide pin slidably engages the fabric guide positioning means.

15. A presser foot as set forth in claim 14, wherein the stop guide pin includes means for preventing disassociation of the fabric guide from the sole.

16. A presser foot as set forth in claim 13, including a thread guide pin fixed within a portion of the fabric guide to lie adjacent to and parallel with the edge of the fabric, wherein the thread guide pin extends below the needle dropping hole and lies parallel to the fabric feeding direction.

17. A self-guiding zig-zag satin stitch presser edge foot detachably mounted to a lower end of a presser bar of a sewing machine having a needle vertically reciprocated and swingable laterally of a fabric feeding direction, the presser foot comprising:

a sole to be pressed against a fabric to be sewn, the sole providing a needle dropping hole for allowing the needle to penetrate the fabric, the sole including parallel fabric-engaging skis extending the length of the sole in the fabric feeding direction and defining lateral limits of the needle dropping hole, a front lateral bar extending from at least one of the skis to define a forward limit of the needle dropping hole, and a heel portion extending between the skis to define a rearward limit of the needle dropping hole, wherein the heel portion and the skis cooperatively define a channel on the underside of the sole of sufficient depth to accommodate a thickened satin-stitch hem passing therethrough;

a fabric guide associated with the sole for engaging an edge of the fabric to guide the fabric therealong, the fabric guide including a U-shaped yoke;

means for adjustably positioning the fabric guide laterally with respect to the needle dropping hole, the fabric guide positioning means including a threaded shank fixed with respect to the sole and slidably extending through the yoke, a nut threaded onto the shank and positioned within the yoke, and means for preventing pivotal movement of the fabric guide relative to the threaded shank, the preventing means including a stop guide pin fixed relative to the sole and extending parallel to the threaded shank for engaging the fabric guide; and a thread guide pin fixed within a portion of the fabric guide to lie adjacent to the edge of the fabric, wherein the thread guide pin extends below the needle dropping hole and lies parallel to the fabric feeding direction.

* * * * *